US010273755B1

(12) United States Patent
Beuerlein et al.

(10) Patent No.: US 10,273,755 B1
(45) Date of Patent: Apr. 30, 2019

(54) CONVERTIBLE FRAMEWORK FOR POST HOLE DIGGER

(71) Applicant: Frictionless World LLC, Wesminster, CO (US)

(72) Inventors: Jesse Beuerlein, Denver, CO (US); Daniel Banjo, Boulder, CO (US)

(73) Assignee: Frictionless World, LLC, Westminster, CO (US)

( * ) Notice: Subject to any disclaimer, the term of this patent is extended or adjusted under 35 U.S.C. 154(b) by 0 days.

(21) Appl. No.: 15/869,288

(22) Filed: Jan. 12, 2018

(51) Int. Cl.

| | |
|---|---|
| ***E21B 7/02*** | (2006.01) |
| ***E21B 19/087*** | (2006.01) |
| ***E21B 4/16*** | (2006.01) |
| ***E21B 10/08*** | (2006.01) |
| *E02D 5/80* | (2006.01) |

(52) U.S. Cl.
CPC ..... *E21B 7/028* (2013.01); *E21B 4/16* (2013.01); *E21B 10/08* (2013.01); *E21B 19/087* (2013.01); *E02D 5/801* (2013.01)

(58) Field of Classification Search
CPC . E21B 4/16; E21B 7/028; E21B 10/08; E21B 19/087
See application file for complete search history.

(56) References Cited

U.S. PATENT DOCUMENTS 2,662,736 A * 12/1953 Abrams ..... E21B 7/02 173/26
4,961,471 A * 10/1990 Ovens ..... E21B 19/087 173/185
5,507,354 A * 4/1996 Harleman ..... E21B 19/087 173/185
5,558,169 A * 9/1996 Madgwick ..... E21B 7/022 173/185
5,586,743 A * 12/1996 Sodolak ..... E21B 7/028 248/125.2
5,662,176 A * 9/1997 Madgwick ..... E21B 7/022 173/185
5,678,801 A * 10/1997 Billingsley ..... E21B 3/02 248/176.1
6,056,065 A * 5/2000 Campbell ..... E21B 7/02 172/254
6,419,245 B1 * 7/2002 Trimble ..... B62B 3/02 175/162
6,763,890 B2 * 7/2004 Polsky ..... E21B 15/003 166/360
7,073,592 B2 * 7/2006 Polsky ..... E21B 15/003 166/360
7,357,399 B1 * 4/2008 Klotz ..... E21B 7/028 248/676
7,717,195 B2 * 5/2010 Paskar ..... E21B 7/005 173/185
7,743,852 B2 * 6/2010 Paskar ..... E21B 7/005 173/185
9,834,999 B2 12/2017 Fraley

* cited by examiner

*Primary Examiner* — Matthew R Buck
(74) *Attorney, Agent, or Firm* — Marsh Fischmann & Breyfogle LLP; Jonathon A. Szumny

(57) ABSTRACT

Utilities (e.g., apparatuses, systems, methods, etc.) for use in converting a container (e.g., crate, box, packaging) within which a post hole digger (e.g., unassembled) is disposed into a stand useful for facilitating connection of the post hole digger to a tractor or the like.

16 Claims, 10 Drawing Sheets

CONVERTIBLE FRAMEWORK FOR POST HOLE DIGGER

FIELD

The present invention relates post hole diggers and, more particularly, to the attachment of post hole diggers to tractors.

BACKGROUND

A post hole digger is a tool used to dig narrow holes to install posts, such as for fences and signs. An auger-type post hole digger includes a rotating helical screw blade that can form a hole in the ground that is at least as deep as the length of the screw shaft.

Connecting and disconnecting an auger-type post hole digger to and from a tractor is a difficult task due to the size and weight of the assembly. The job often requires a number of individuals to support the device and make the required connections. For instance, the operator of the tractor must back the tractor to the position where the post auger was last unattached, align at least one trailing arm within about two inches of one side of the yoke, and align both arms with both side pins on the yoke. Maneuvering the tractor with such precision to the location of the post auger usually requires several back and forth moves with the tractor consuming considerable time. The trailing arms must then be lowered to positions close to the yoke pins which may also require leaving the tractor engine operating in order to raise and lower the trailing arms for more precise alignment with the pins resulting in unsafe tractor operating practices.

Once the pins are closely aligned with trailing arms, the operator must turn off the engine and exit the tractor, move each trailing arm laterally to engage the pin on the yoke on that side and thereafter move to the other side of the post auger and place the second trailing arm on the respective pin on the yoke. The third point of the hitch is not yet connected to the boom which requires the operator to mount the tractor seat, restart the engine, engage the tractor in forward motion and drag the auger shaft along the ground until the point of the auger digs into the ground raising the post auger to an upright position with the auger shaft substantially vertical. While this operation raises the boom hitch point toward the third point of the hitch, great skill is required to exactly align the hitch point on the boom with the third arm. Usually, the operator exits the tractor seat and rocks the post auger or tractor forward or backward in order to align the holes and place the pin through both the boom and the third arm; this practice can result in unsafe tractor operating procedures. Once the post auger is finally affixed to the three-point hitch, the operator must again mount the tractor seat, start the tractor engine if it were turned off when the operator last dismounted and raise the post auger from the ground before moving to a location for drilling. The inaccuracies in alignment using the tractor for aligning often results in pinched fingers, strained muscles or severe injury when attaching the post auger to the tractor.

SUMMARY

There have been stands developed in the past that facilitate the connection of post hole diggers to tractors. For instance, after the unassembled pieces of a post hole digger have been removed from a container (e.g., crate, box, packaging, etc.) and at least partially assembled, the container is discarded and then the digger pieces are suspended from or otherwise attached to a stand in preparation for attachment of the digger to a tractor. However, such stands make up additional pieces of equipment that operators must order or otherwise obtain (in addition to the post hole digger and the container therefore) when the post hole diggers are initially acquired. This situation results in wasted materials and wasted time and expenses associated with having to separately coordinate acquisition of the digger stand, among other inefficiencies.

In view of at least the foregoing, disclosed herein are various utilities (e.g., methods, systems, etc.) for use in converting the container used to transport a post hole digger into a stand to which the post hole digger may be attached for use in facilitating connection of the digger to a tractor or the like. Upon receipt of the container (e.g., crate, box, packaging) that stores a post hole digger (e.g., unassembled), the various pieces of the digger may be removed from the container and set aside. Thereafter, the pieces of the container itself may be at least partially disassembled and reassembled into a stand for supporting the digger for attachment to a tractor or the like. The disclosed utilities allow for recycling of the digger container to create a stand useful in facilitating connection of the digger to a tractor (e.g., and/or for presentation of the digger or the like) and limit the need to purchase or acquire additional equipment.

In one aspect, a method for use with a post hole digger includes receiving a package that includes a framework made up of a plurality of framework pieces connected together in a first configuration; removing a plurality of pieces of a post hole digger from an internal space inside of the first framework; disassembling the plurality of framework pieces of the first framework; assembling the plurality of framework pieces into a second configuration different than the first configuration; and attaching the plurality of pieces of the post hole digger to the second framework.

In another aspect, a kit includes a framework made up of a plurality of framework pieces connected together in a first configuration, the first configuration of the framework including an internal space inside the plurality of framework pieces; a plurality of pieces of a post hole digger disposed within the internal space; and instructions comprising first information that directs a user how to disassemble the plurality of framework pieces and then reassemble the plurality of framework pieces into a second configuration different than the first configuration.

Upon one or more pieces of the post hole digger being rested on or attached to the second configuration of the framework, the one or more pieces of the post hole digger may be in a position that facilitates connection of the post hole digger to a tractor. For instance, the framework may be disassembled from its first configuration and reassembled into the second configuration adjacent the tractor. In another arrangement, the framework may be disassembled from its first configuration and reassembled into the second configuration at a distance from the tractor and then moved (e.g., rolled) to a position adjacent the tractor.

Any of the embodiments, arrangements, and the like discussed herein may be used (either alone or in combination with other embodiments, arrangement, and the like) with any of the disclosed aspects. Any feature disclosed herein that is intended to be limited to a "singular" context or the like will be clearly set forth herein by terms such as "only," "single," "limited to," or the like. Merely introducing a feature in accordance with commonly accepted antecedent basis practice does not limit the corresponding feature to only such feature. Moreover, any failure to use phrases such as "at least one" also does not limit the corresponding feature to the singular. Use of the phrase "generally," "at least generally," "substantially," "at least substantially" or the like in relation to a particular feature encompasses the corresponding characteristic and insubstantial variations thereof. Finally, a reference of a feature in conjunction with the phrase "in one embodiment" or the like does not limit the use of the feature to a single embodiment.

Reference will now be made to the following drawings which assist in illustrating the various pertinent features of the various novel aspects of the present disclosure.

DETAILED DESCRIPTION

Figure 1:
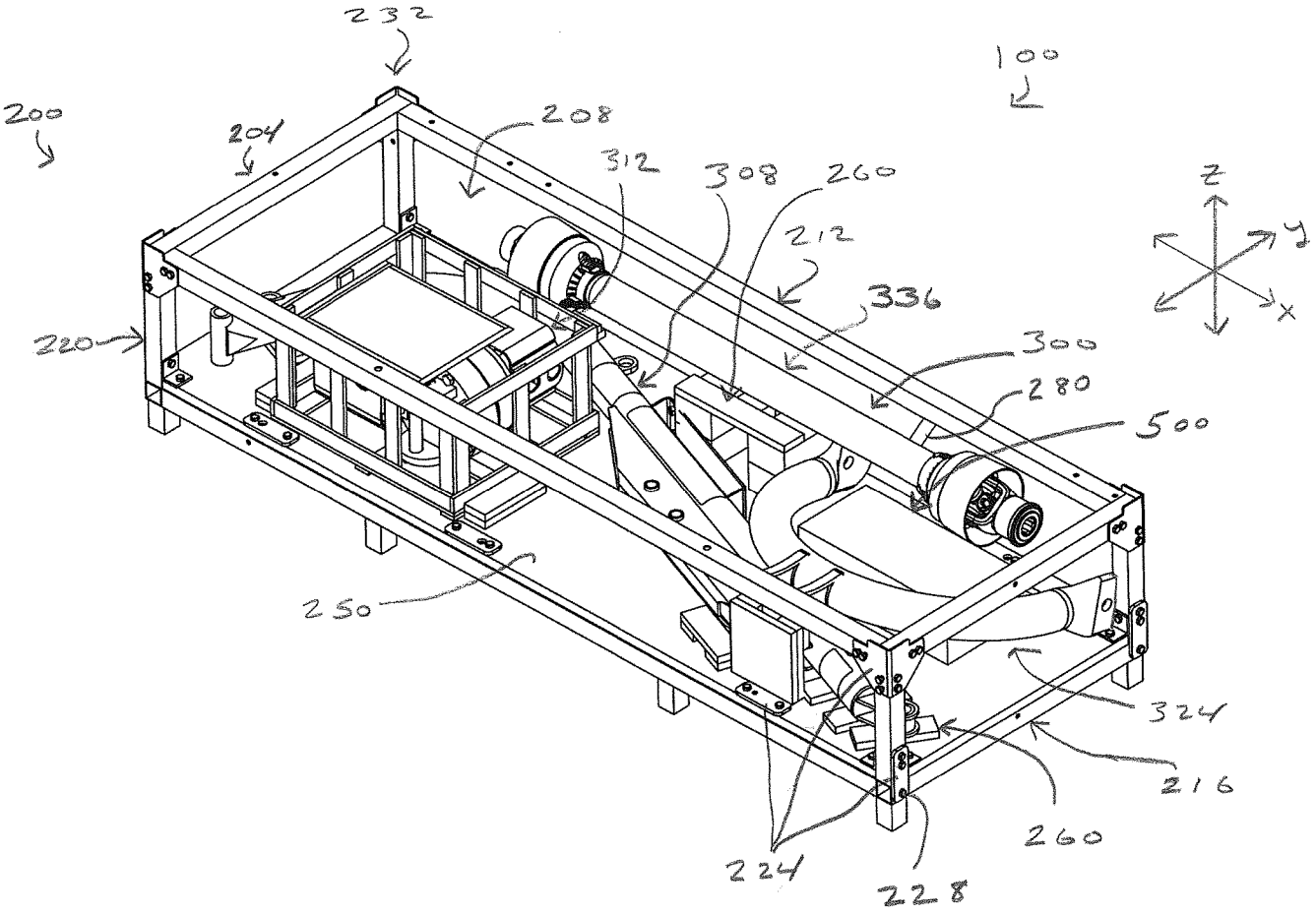
FIG. 1 is a perspective view of an apparatus including a framework of pieces in a first configuration and a post hole digger being disposed inside of the framework.
Figure 4:
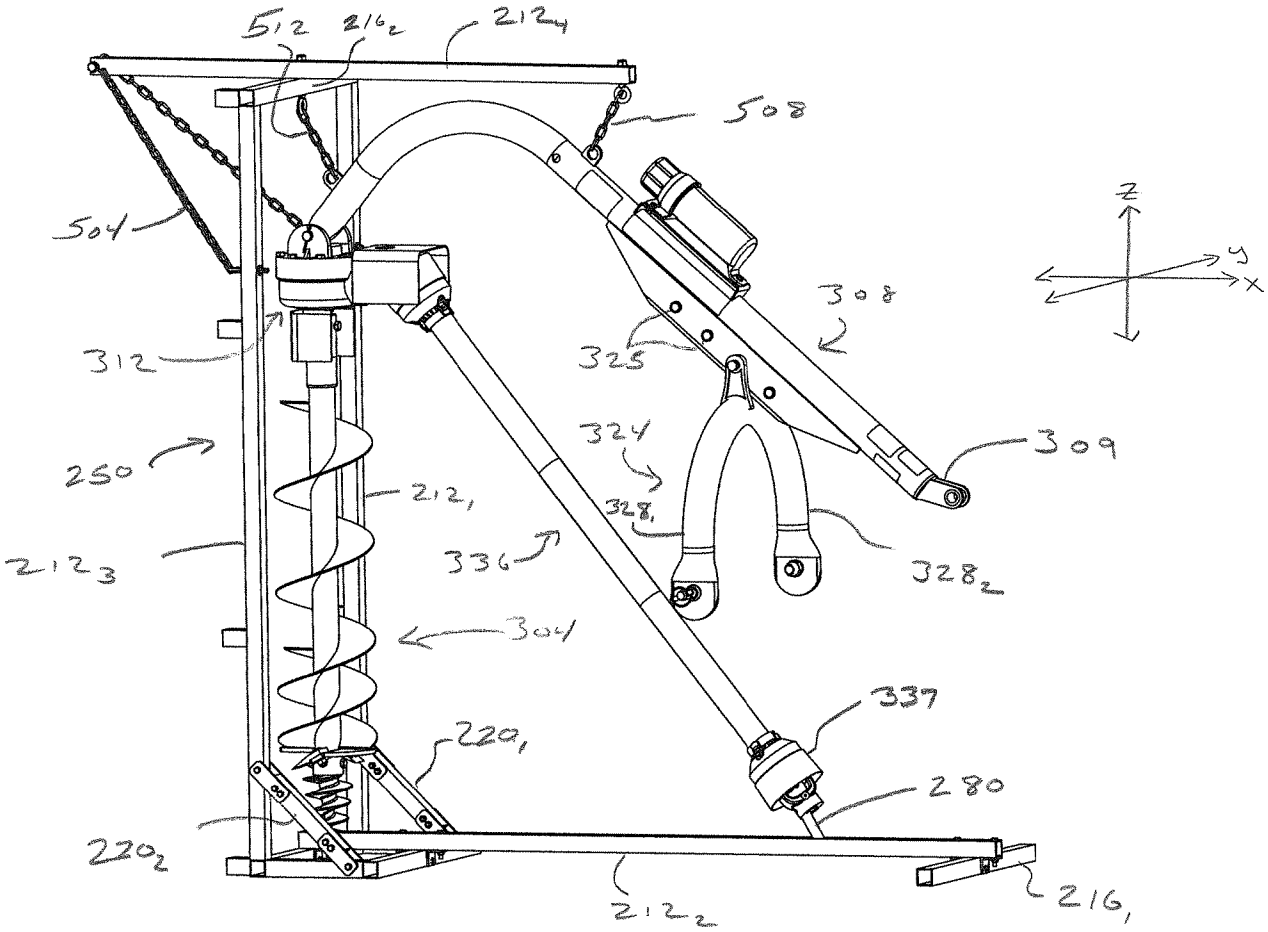
FIG. 4 is a perspective view of the post hole digger of FIG. 1 being attached to the second framework configuration of FIG. 3*e*.
Figure 7:
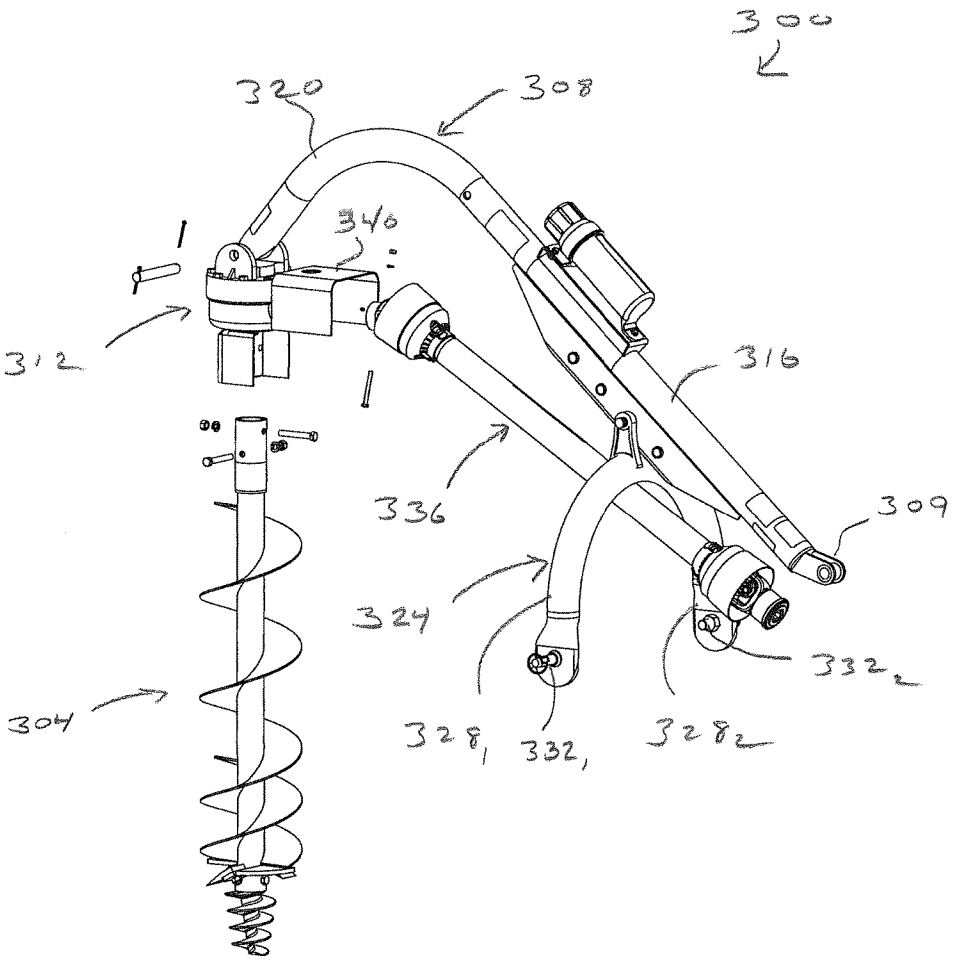
FIG. 7 is a partially assembled perspective view of the post hole digger of FIG. 1.

FIG. 1 presents a perspective view of a system 100 that includes an apparatus 200 and a post hole digger (PHD) 300 (generally unassembled) disposed inside the apparatus 200 for use in creating generally cylindrical holes (not shown) in the ground such as for fence posts and the like. Before discussing how the apparatus 200 can be converted from a container (e.g., as shown in FIG. 1) into a stand (e.g., as shown in FIG. 4) useful for facilitating connection of the PHD 300 to a tractor or the like, reference will now be made to FIG. 7 which presents a partially assembled perspective view of the PHD 300.

As shown, the PHD 300 generally includes an auger 304 for drilling into the ground or the like and that may include a helical blade of any appropriate size, dimensions, etc. The auger 304 may be supported by a boom 308 (e.g., curved support arm) that is extendable from a three point hitch 412 disposed between first and second rear tires 404, 408 of a tractor 400 (e.g., shown in FIG. 5), where the auger 304 may be interconnected to the boom 308 via a gearbox 312 in any appropriate manner. For instance, the boom 308 may have a first arm 316 and a second arm 320 that is shorter than the first arm 316. A free end (not labeled) of the second arm 320 may be pivotally connected to the gearbox 312 while a free end 309 of the first arm 316 may be removably attachable to a central arm or point 416 of the three point hitch 412 (e.g., via pin, not shown).

Boom 308 is mounted on or to a yoke 324 (e.g., A-frame) subassembly via pivot pin 326, where the yoke 324 includes first and second arms $\mathbf{328}_1$, $\mathbf{328}_2$ having respective pins $\mathbf{332}_1$, $\mathbf{332}_2$ that are pivotally attachable to respective first and second trailing arms $\mathbf{420}_1$, $\mathbf{420}_2$ of three point hitch 412. A driveline 336 (e.g., rotating shaft, drive shaft) may interconnect the power takeoff (PTO) shaft 424 of the tractor 400 to the gearbox 324 and is configured to translate rotation from the PTO shaft 424 to the auger 304 via the gearbox 324. For instance, the driveline 336 may be a splined hollow shaft or tubing that is rotatable by a user upon actuation of the tractor controls (not shown) and that typically powers farming implements such as the PHD 300. In one arrangement, a shield 324 may be configured to cover moving parts of the gearbox 324 to limit safety hazards to users.

As discussed previously, there have been stands and other supports developed in the past that facilitate the typically difficult and time-consuming task of connecting of PHDs to tractors. For instance, such stands include a number of specific, strategic locations on which specific parts of the PHD are to be supported or otherwise attached that are configured to position the parts of the PHD (e.g., the boom, driveline) in an "optimal" position for attachment to the three point hitch of the tractor. However, such stands make up additional pieces of equipment that operators must order or otherwise obtain in addition to the PHD and the container (e.g., crate, box, etc.) therefore. This situation results in wasted materials and wasted time and expenses associated with having to separately coordinate acquisition of the stand, among other inefficiencies.

Figure 5:
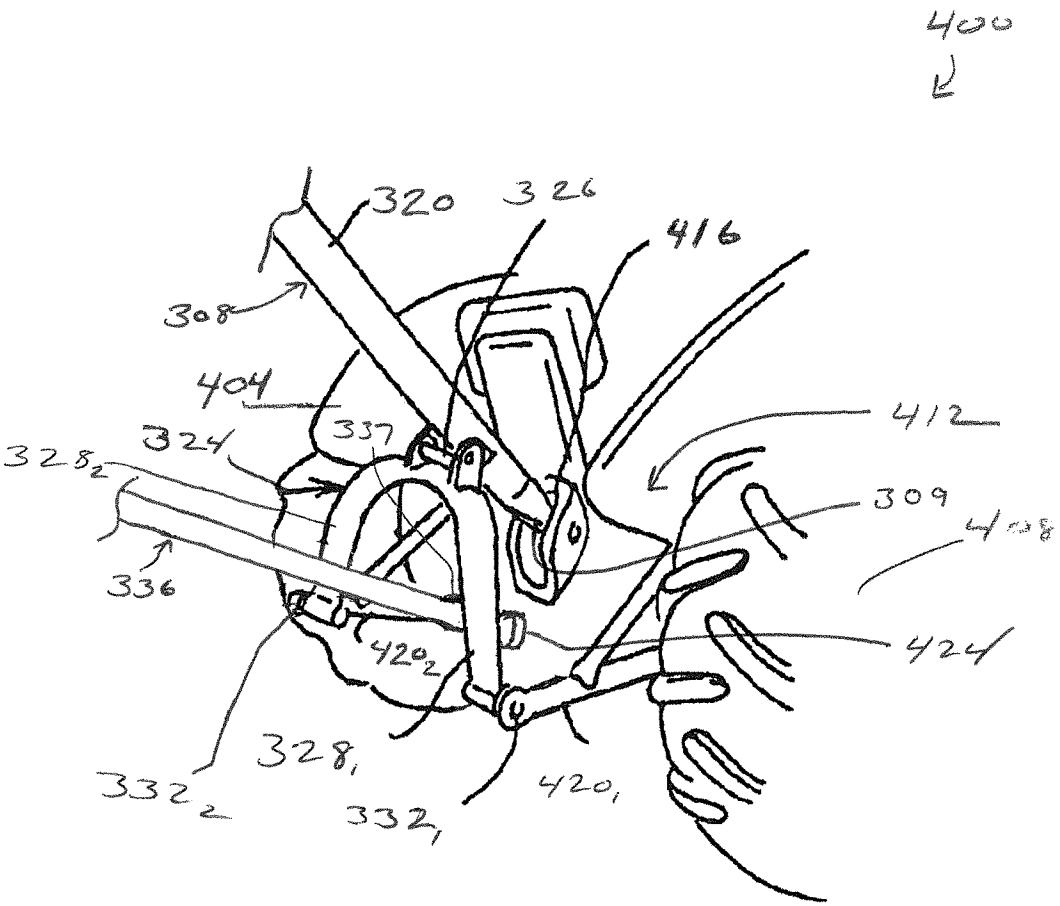
FIG. 5 is a perspective view of the post hole digger of FIG. 4 being connected to the three point hitch of a tractor.

In view of at least the above, the apparatus 200 may be convertible from a container (e.g., crate, box, packaging, etc.) as shown in FIG. 1 in which the PHD 300 may be stored for shipping or transport into a stand or support (as shown in FIG. 4) on which the PHD 300 may be disposed for connection of the PHD 300 to a tractor (e.g., as in FIG. 5). Broadly, the apparatus 200 may include a framework 204 of interconnected pieces (e.g., posts, bars, supports, arms, tubes, etc. of any appropriate material(s)) that may assume a first configuration relative to each other (a container as shown in FIG. 1) and thereby collectively define an interior cavity or space 208 within which the PHD 300 may be disposed or stored in a generally unassembled state. In one embodiment, the apparatus 200 may include a floor 250 (e.g., panel, base, etc.) disposed at a bottom of the framework 204 in the first configuration of FIG. 1 on which the various pieces of the PHD 300 may be supported. The apparatus 200 may also include any other appropriate number and/or type of support pieces 260 (e.g., constructed of wood, plastic, etc.) for use in supporting various pieces of the PHD 300, spacing adjacent pieces of the PHD, etc., to limit damage to the PHD 300 during shipment thereof. While not necessarily being illustrated in the interest of clarity, the apparatus 200 may also include one or more other panels, braces, etc.

The framework 204 may broadly include a plurality of primary framework pieces such as first framework pieces 212 and second framework pieces 216. Additionally, the framework 204 may include a plurality of secondary framework pieces such as third framework pieces 220 disposed between and separating a first or upper portion of the first and second framework pieces 212, 216 and a second or lower portion of the first and second framework pieces 212, 216. A plurality of brackets 224 and fasteners 228 (e.g., bolts) of any appropriate shape or type may be used to removably secure adjacent ones of the framework pieces to each other. For instance, brackets 224 and bolts 228 may be used to secure first, second, and third framework pieces 212, 216, 220 together at each of a plurality of corner portions 232 of the apparatus 200. In some situations, adjacent framework pieces may be non-movably secured together (e.g., via welding or the like) to facilitate conversion of the framework into the second configuration (discussed in more detail below).

In the first framework configuration (e.g., container) of FIG. 1, longitudinal axes of the first framework pieces 212 may all be parallel to each other, longitudinal axes of the second framework pieces 216 may all be parallel to each other, and longitudinal axes of the third framework pieces 212 may all be parallel to each other. Furthermore, the longitudinal axes of the first framework pieces 212 may be perpendicular to the longitudinal axes of the second and third framework pieces 216, 220; the longitudinal axes of the second framework pieces 216 may be perpendicular to the longitudinal axes of the first and third framework pieces 212, 220; and the longitudinal axes of the third framework pieces 220 may be perpendicular to the longitudinal axes of the first and second framework pieces 212, 216. As shown, the first framework may be oriented such that the longitudinal axes of the first framework pieces 212 are parallel to an x-axis, the longitudinal axes of the second framework pieces 216 are parallel to a y-axis, and the longitudinal axes of the third framework pieces 220 are parallel to a z-axis (e.g., or in other words so that the longitudinal axes of the first and second framework pieces 212, 216 are horizontal and the longitudinal axis of the third framework pieces 220 are vertical). This arrangement allows for a longitudinal axis of the internal space 208 to be horizontal and thus the various pieces of the PHD 300 to be laid on their side within the internal space 208 during shipping and transport of the apparatus 200 and PHD 300.

Figure 2:
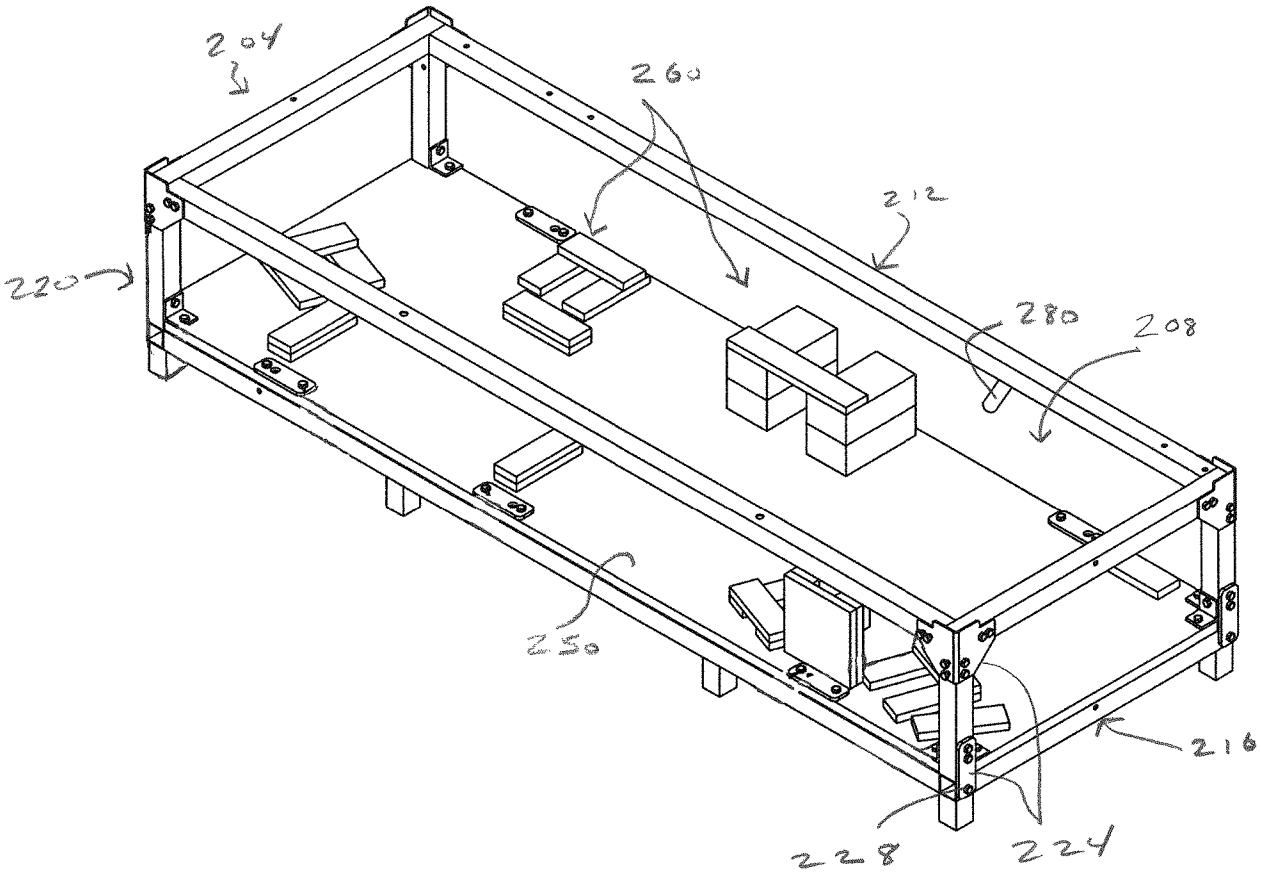
FIG. 2 is a perspective view of the container of FIG. 1, but with the post hole digger removed.

The pieces of the framework 204 may also assume a second configuration relative to each other (as shown in FIG. 4) and thereby collectively define a stand on which the various pieces of the PHD 300 may be disposed for connection of the PHD 300 to a tractor. To convert the framework 204 from the first configuration to the second configuration, the pieces of the PHD 300 may be initially removed from the internal space 208 of the first configuration of the framework 204 and temporarily set aside in any appropriate location. For instance, FIG. 2 illustrates the first configuration of the framework 204 with the PHD 300 being removed therefrom.

Figure 3A:
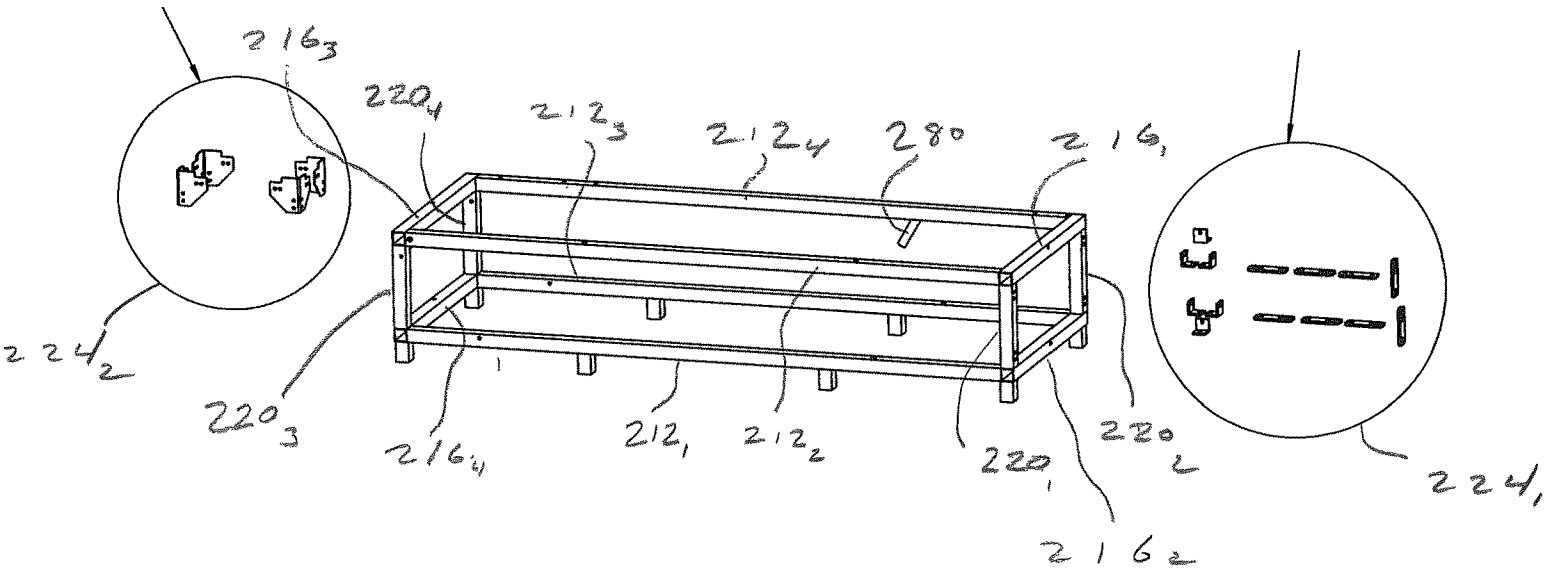
FIGS. 3*a*-3*e* present perspective views of the container of FIG. 2 in a plurality of steps of converting the framework of pieces from the first configuration of FIG. 1 into a second configuration on which the post hole digger may be supported for use in facilitating connection of the post hole digger to a tractor.

As an initial stage of the reassembly of the framework 204 from the first configuration to the second configuration, one or more pieces of the apparatus 200 may be removed from the framework 204 and set aside (or discarded, depending on the piece) such as the support pieces 260, the floor 250, one or more of the brackets 224 and bolts 228, etc. For example, at least a first subset $\mathbf{224}_1$ of the brackets (e.g., flat pieces, small angle pieces, etc.) may be retained for use in securing the framework 204 in the second configuration as discussed below. As another example, a second subset $\mathbf{224}_2$ of the brackets (e.g., angled corner pieces) may be discarded or used for purposes other than from securing the framework 204 in the second configuration. See FIG. 3*a*.

Figure 3B:
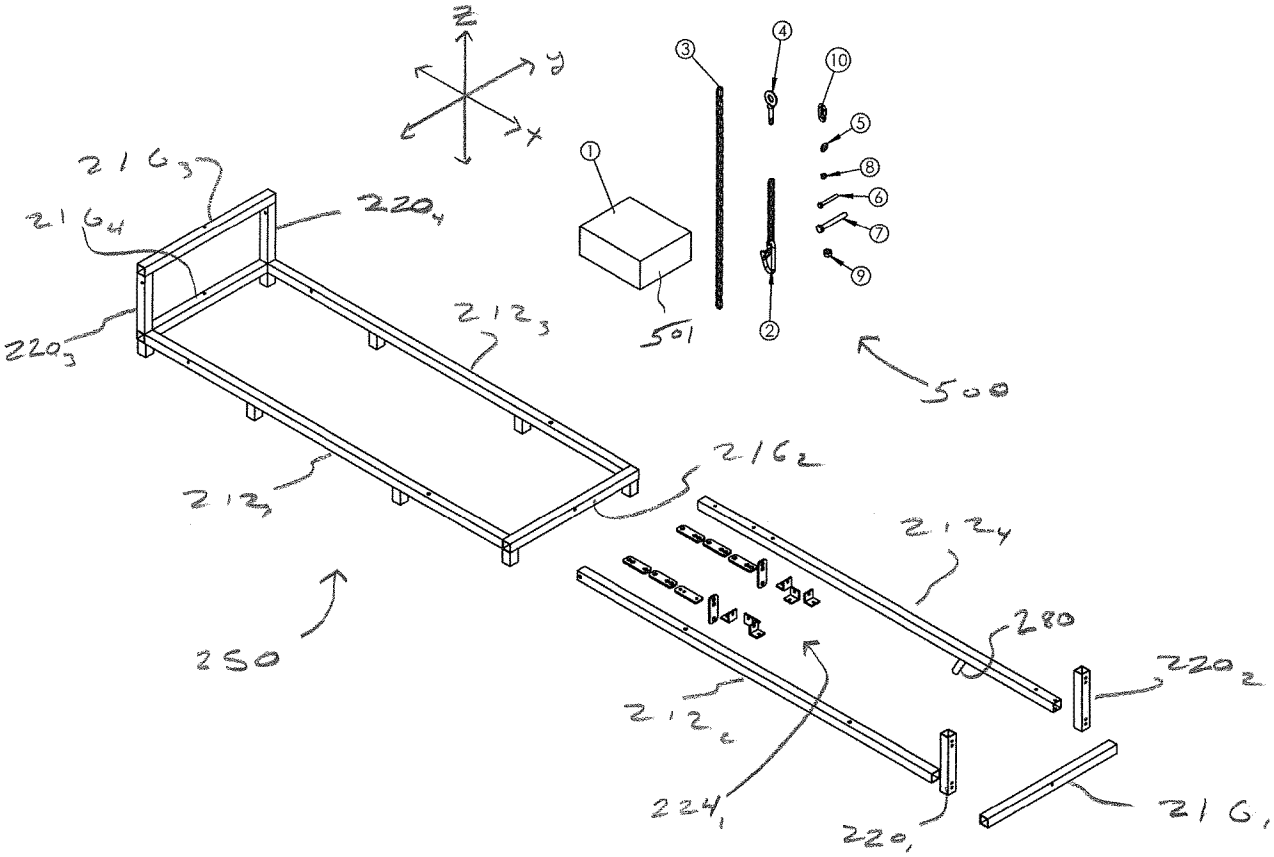

Thereafter, second and fourth of the first framework pieces $\mathbf{212}_2$, $\mathbf{212}_4$ and a first of the second framework pieces $\mathbf{216}_1$ (some of the upper primary framework pieces) may be removed from the first framework configuration and set aside. Part of this process may also include removing first and second of the third framework pieces $\mathbf{220}_1$, $\mathbf{220}_2$ (some of the secondary framework pieces) from the first framework configuration and setting the pieces aside. See FIG. 3*b*. In one arrangement, the remaining pieces of the framework 204 (e.g., first and third of the first framework pieces $\mathbf{212}_1$, $\mathbf{212}_3$; second, third, and fourth of the second framework pieces $\mathbf{216}_1$ $\mathbf{216}_3$, $\mathbf{216}_4$; third and fourth of the third framework pieces $\mathbf{220}_3$, $\mathbf{220}_4$) may remain connected together as a unit 250 in the same configuration (e.g., same spacing, angles, etc.) relative to each other in both the first configuration of the framework 204 (as shown in FIG. 1) and the second configuration of the framework 204 (as shown in FIG. 4). Stated differently, such pieces of the unit 250 need not be separated from each other as a user converts the framework 204 from the first configuration to the second configuration. In one arrangement, the pieces of the unit 250 may be welded or otherwise non-removably attached to each other.

Figure 3C:
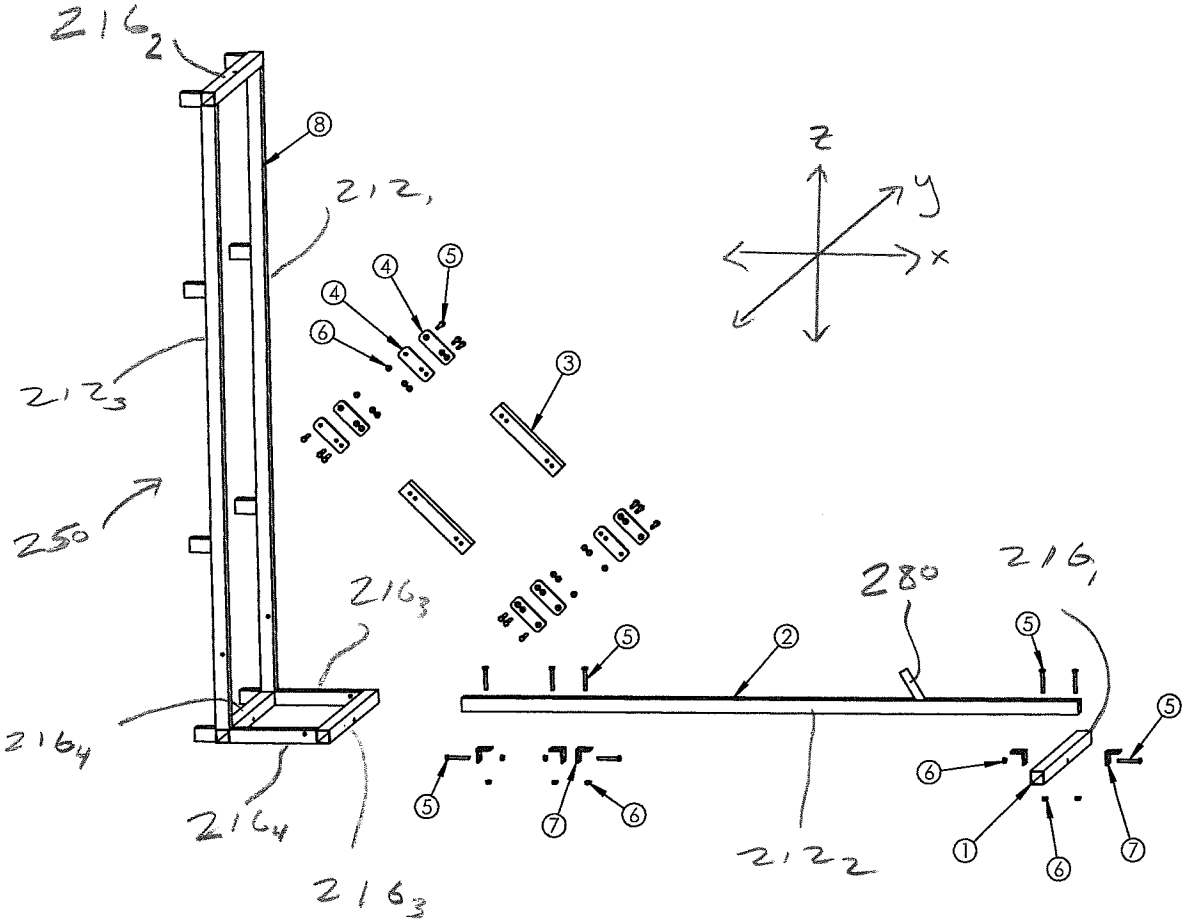
Figure 3E:
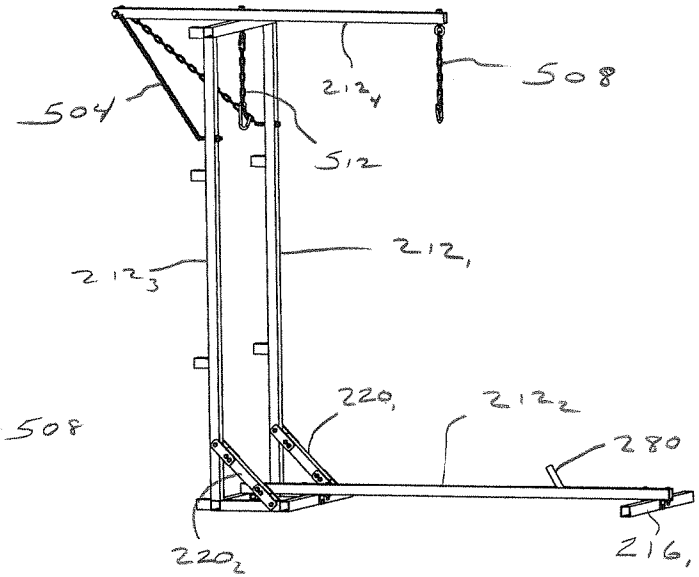
Figure 3D:
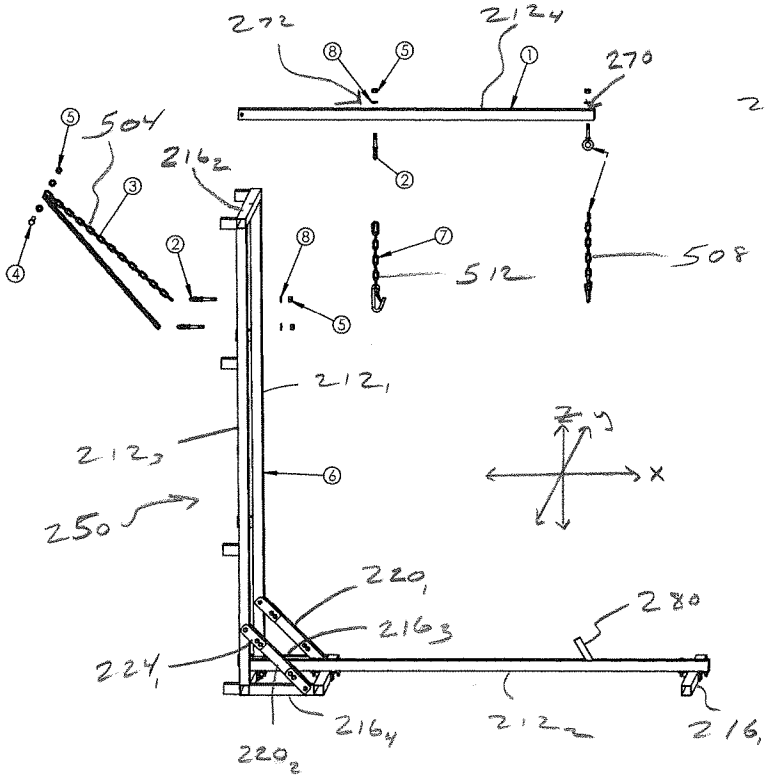

In a next step, the unit 250 may be rotated or otherwise repositioned so that the first and third first framework pieces $\mathbf{212}_1$, $\mathbf{212}_3$ are disposed vertically (generally parallel to the z-axis) and so that the remaining pieces of the unit 250 are disposed horizontally (generally parallel to the x or y-axes). See FIG. 3*c*. Additionally, one of the separated primary framework pieces may be rigidly connected to the unit 250 such that its longitudinal axis is at least substantially perpendicular to the primary framework pieces of the unit 250. For instance, and with reference now to FIGS. 3*c*-3*d*, the second first framework piece $\mathbf{212}_2$ may be rigidly attached (e.g., via first subset of brackets $\mathbf{224}_1$ and bolts 228) to the third and fourth second framework pieces $\mathbf{220}_3$, $\mathbf{220}_4$ (e.g., over the top of the third and fourth second framework pieces $\mathbf{220}_3$, $\mathbf{220}_4$) such that its longitudinal axis is substantially perpendicular to those of the first and third first framework pieces $\mathbf{212}_1$, $\mathbf{212}_3$.

In this regard, the second first framework piece $\mathbf{212}_2$ may be configured to serve as a base support for the stand whose longitudinal axis extends generally horizontally. For instance, the newly created base support may be configured to inhibit forward tipping of the first and third first framework pieces $\mathbf{212}_1$, $\mathbf{212}_3$ (or the unit 250 as a whole) in a direction towards the base support (e.g., along a reference plane that is parallel to the x and z-axes) and thereby maintain stability of the stand. In one arrangement, the first second framework piece $\mathbf{216}_1$ may be rigidly attached to the second first framework piece $\mathbf{212}_2$ such that its longitudinal axis is substantially perpendicular to that of the second first framework piece $\mathbf{212}_2$. This arrangement may be configured to inhibit lateral tipping of the unit 250 and the stand (along a reference plane parallel to the y and z-axes). As shown, the first second framework piece $\mathbf{216}_1$ may be rigidly attached underneath to a bottom portion of the second first framework piece $\mathbf{212}_2$ to level the stand and maintain the first and third first framework pieces $\mathbf{212}_1$, $\mathbf{212}_3$ in substantially vertical positions.

To further enhance the stability of the stand, the first and third first framework pieces $\mathbf{212}_1$, $\mathbf{212}_3$ may be respectively braced relative to the third and fourth second framework pieces $\mathbf{220}_3$, $\mathbf{220}_4$ in any appropriate manner. In one arrangement, the first third framework piece $\mathbf{220}_1$ may be rigidly attached to the first first framework piece $\mathbf{212}_1$ and the third second framework piece $\mathbf{216}_3$ such as with some of the first subset of brackets $\mathbf{224}_1$ and bolts 228. For instance, the first third framework piece $\mathbf{220}_1$ may be attached such that its longitudinal axis is non-parallel and non-perpendicular to the longitudinal axes of the first first framework piece $\mathbf{212}_1$ and the third second framework piece $\mathbf{216}_3$. As another example, the second third framework piece $\mathbf{220}_2$ may be rigidly attached to the third first framework piece $\mathbf{212}_3$ and the fourth second framework piece $\mathbf{216}_4$ such as with some of the first subset of brackets $\mathbf{224}_1$ and bolts 228. For instance, the the second third framework piece $\mathbf{220}_2$ may be attached such that its longitudinal axis is non-parallel and non-perpendicular to the longitudinal axes of the third first framework piece $212_3$ and the fourth second framework piece $216_4$. While the first and second third framework pieces $220_1$, $220_2$ are illustrated as being attached to outside surfaces of the first framework piece $212_1$ and the third second framework piece $216_3$, and the third first framework piece $212_3$ and the fourth second framework piece $216_4$, respective, it is also envisioned that the first and second third framework pieces $220_1$, $220_2$ could be attached to the inside or other surfaces as well.

In one embodiment, one or more framework or other pieces may be secured to the unit 250 from which one or more pieces of the PHD 300 may be secured or suspended for use in connecting the PHD 300 to a tractor. As an example, the fourth first framework piece $212_4$ may be secured to the unit 250 in any appropriate manner such that it cantilevers off of the unit 250 (e.g., where its longitudinal axis is substantially perpendicular to those of the first and third first framework pieces $212_1$, $212_3$). See FIG. 3*e* which illustrates a second configuration of the framework 204 and serves as a stand for the PHD 300. For instance, the fourth first framework piece $212_4$ may be secured to the second second framework piece $216_2$ such as with one or more fasteners (e.g., bolts, washers, nuts, etc., not labeled) in any appropriate manner (e.g., such as via inserting a bolt through aligned apertures in the fourth first framework piece $212_4$ and the second second framework piece $216_2$). As another example, the fourth first framework piece $212_4$ may be secured to first and/or third first framework pieces $212_1$, $212_3$ such as via one or elongated members 504 (e.g., chains, cords, ropes, braces, etc., not labeled) interconnected between the fourth first framework piece $212_4$ and the first and/or third first framework pieces $212_1$, $212_3$ (e.g., via bolts (not labeled) extending through the elongated members 504 and the framework pieces).

The fourth first framework piece $212_4$ may include one or more attachment points for use in suspending one or more pieces of the PHD 300 therefrom. For instance, the fourth first framework piece $212_4$ may include a first attachment point 270 to which a suspension member 508 (e.g., chain, rope, cord, bracket) may be attached (e.g., via bolts, nuts, etc.) from which a piece of the PHD 300 may be suspended as discussed below. The fourth first framework piece $212_4$ may also include a second attachment point 272 to which another suspension member 512 may be attached and which may coincide with the location at which the fourth first framework piece $212_4$ is connected to the second second framework piece $216_2$. For instance, the suspension members 508, 512 may include hooks or other quick connection members (not labeled) for use in connection to pieces of the PHD 300.

While two attachments points are illustrated, it is to be understood that one or more additional attachment points may be includes along the fourth first framework piece $212_4$ for use in attaching additional suspension members, for use in providing additional locations to which the suspension members 508, 512 may be attached, etc. so as to allow various different types of PHDs 300 to be used with the apparatus. This arrangement also provides a user with the ability to position a PHD 300 so as to accommodate the specific type of tractor to which the PHD 300 is to be connected. In one arrangement, one or more of the fasteners, elongated members, suspension members, etc. used to construct the stand (i.e., the second configuration of the framework 204) may be included as part of a kit 500 (where the various parts are included in a container 501) that may be included along with the PHD 300 within the first configuration of the framework 204 as shown in FIG. 1 (also see FIG. 3*b*).

Reference is now made to FIG. 4 to illustrate how the pieces of a PHD 300 may be suspended from and supported on the framework 204 in its second configuration (i.e., as a stand). As shown, the boom 308 of the PHD 300 may be suspended from the fourth first framework piece $212_4$. For instance, the first suspension member 508 may be attached to the boom 308 in any appropriate manner (e.g., such as passing a hook of first suspension member 508 through a rigid eyelet on the boom 508). As another example, the boom 308 may be suspended from the second second framework piece $216_2$ such as by attaching the second suspension member 512 to the boom 308 (e.g., at a location spaced from the location at which the first suspension member 508 is attached to the boom 308) in any appropriate manner (e.g., such as passing a hook of first suspension member 508 through another rigid eyelet on the boom 508). However, the boom 308 may be suspended from the fourth first framework piece $212_4$ in other manners as well. In one variation, a chain, rope or the like may be wrapped around the boom 308 (e.g., under the curved portion of the boom 308) and secured to the fourth first framework piece $212_4$.

The yoke 324 of the PHD 300 may be secured to the boom 308 (e.g., at one of a plurality of attachment holes 325 depending on the location/dimensions of the three point hitch 412 on the tractor 400) either before or after the boom 308 is suspended from fourth first framework piece $212_4$ of the apparatus. Furthermore, the gearbox 312 and auger 304 of the PHD 300 may be attached to the boom 308 either before or after the boom 308 is suspended from fourth first framework piece $212_4$ of the apparatus. As shown, the auger 304 may generally hang down from the gearbox 312 such that a longitudinal axis of the auger 304 is substantially parallel to the z-axis and is disposed generally underneath the second second framework piece $216_2$ and the fourth first framework piece $212_4$ and between the first and third first framework pieces $212_1$, $212_3$. The elongated members 504 may serve as a counterweight on one side of the unit 250 to the weight of the boom 308 on an opposite side of the unit 250.

Still further, the driveline 336 of the PHD 300 may be attached to the gearbox 312 either before or after the boom 308 is suspended from fourth first framework piece $212_4$ of the apparatus. In one arrangement, the PTO end 337 of the driveline 336 may be located over a positioning member 280 on the second first framework member $212_2$ for use in positioning the PTO end 337 adjacent or near the PTO shaft 424 of the tractor 400 during attachment to the three-point hitch 412. For instance, the positioning member 280 may be in the form of a protruding member (e.g., bar, bracket, arm, shaft, pole) rigidly attached to the second first framework member $212_2$ that is configured to be at least partially received by the PTO end 337 of the driveline 336.

The second configuration of the framework 204 (e.g., stand) illustrated in FIG. 4 positions the boom 308 and yoke 324 to be more easily connected to the three point hitch 412 of the tractor 400 and the driveline 336 to be more easily connected to the PTO shaft 424 of the tractor 400. With reference now to FIGS. 4 and 5, use of the stand (second configuration of the framework 204) to connect the PHD 300 to the tractor 400 will now be discussed. The boom 308 and driveline 336 of the PHD 300 in FIG. 5 have been simplified in the interest of clarity. The PHD 300 may be attached to/suspended from the stand as discussed herein adjacent the rear of tractor 400 near three point hitch 412 and PTO shaft 424. Alternatively, the PHD 300 may be attached to/suspended from stand remote from the tractor 400 and then the tractor 400 may be drive to the stand/PHD 300. Still further, the stand may be modified to include wheels or the like and then the stand/PHD 300 may be rolled/moved to the tractor 400.

In any case, it can be seen how use of the stand generally positions and orients a) the end 309 of the boom 308 so as to facilitate connection to the central point 416 of the three point hitch 412, b) the first and second arms $\mathbf{328}_1$, $\mathbf{328}_2$ of yoke 324 to facilitate connection to the first and second trailing arms $\mathbf{420}_1$, $\mathbf{420}_2$ of the three point hitch 412, and c) the PTO end 337 of the driveline 336 to facilitate connection to the PTO shaft 424. To "fine tune" the specific positioning of the various pieces of the PHD 300, the boom 308 may be attached to one or both of the suspension members 508, 512 at a different location on the suspension members 508, 512 (e.g., such as at a different link in the case of the suspension members 508, 512 being chains). Additionally or alternatively, one or both of the suspension members 508, 512 may be attached to the fourth first framework member $\mathbf{212}_4$ at a different attachment point along the length of the fourth first framework member $\mathbf{212}_4$.

After connection of the PHD 300 to the tractor 400, the stand may be detached from the PHD 300 and moved away to allow an operator of the tractor 400 to drill holes in the ground or the like with the PHD 300. After use of the PHD 300 with the tractor 400, the PHD 300 may in some situations be removed from the tractor 400 and reattached to/rehung from the stand in preparation for a subsequent connection to the tractor 400.

Figure 6:
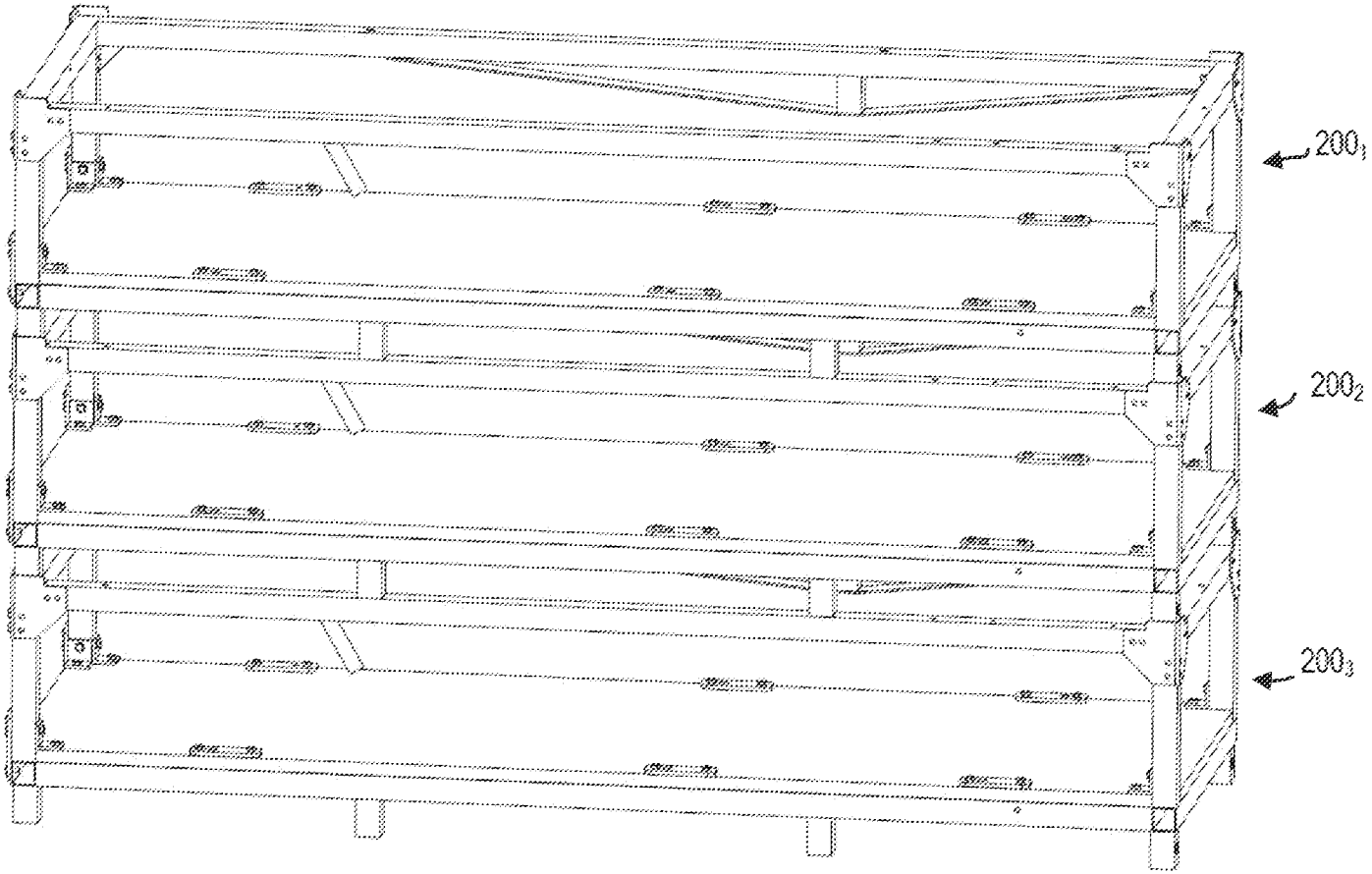
FIG. 6 is a perspective view illustrating the stackability of a plurality of the apparatuses of FIG. 1.

FIG. 6 illustrates how a plurality of apparatuses 200 (e.g., $\mathbf{200}_1$, $\mathbf{200}_2$, $\mathbf{200}_3$) in the first configuration of the framework 204 may be stacked on top of each other to make more efficient use of space in a semi-trailer or other shipping apparatus or storage location.

The apparatus 200 of FIG. 1 may include or otherwise be associated, along with the PHD 300, parts kit 500, etc., one or more sets of instructions for use with the apparatus 200, PHD 300, etc. The instructions may be in the form of a booklet, packet, etc. of written information (e.g., printed matter on paper or sheet material) enclosed within the apparatus 200 (within or on the framework in its first configuration). Alternatively, the instructions may be in electronic form and accessible via a website or the like. The apparatus 200 and PHD 300 may form a kit along with the instructions.

For instance, the instructions may include first information that directs a user how to disassemble the plurality of framework pieces of the first configuration of the framework 204 (e.g., the container) and then assemble the plurality of framework pieces into a second configuration different than the first configuration (e.g., the stand). The instructions may also include second information that directs a user how to attach one or more of the plurality of pieces of the PHD 300 to the second configuration of the framework 204. The instructions may also include third information that directs a user how to attach one or more of the plurality of pieces of the PHD 300 to one or more other of the plurality of pieces of the PHD 300.

The foregoing description has been presented for purposes of illustration and description. Furthermore, the description is not intended to limit the invention to the form disclosed herein. Consequently, variations and modifications commensurate with the above teachings, and skill and knowledge of the relevant art, are within the scope of the disclosure herein. As an example, the various pieces of the framework 204 may be disassembled from the first configuration and reassembled into a second configuration (e.g., to serve as a stand or the like) in manners different than disclosed herein). For instance, while the second first framework piece $\mathbf{212}_2$ is illustrated as having one end attached to the fourth second framework piece $\mathbf{216}_4$, it is envisioned that an approximate midpoint of the second first framework piece $\mathbf{212}_2$ may be attached to the fourth second framework piece $\mathbf{216}_4$ such that first and second opposite free ends of the second first framework piece $\mathbf{212}_2$ extend outwardly from first and second opposite sides of the unit 250 so as to resist tipping of the unit 250 in first and second opposite directions.

As another example, one or more of the framework pieces may be telescoping or the like to provide extra levels of adjustability of the framework to allow the framework to accommodate various different types of PHDs 300 and tractors 400. In some arrangements, one or more of the framework pieces may be cut (e.g., shorted) as necessary before conversion of the framework 204 into the second configuration depending upon the particular dimensions, circumstances, etc. (e.g., such as the fourth first framework piece $\mathbf{212}_4$). It is noted that not all pieces of the PHD 300 need to necessarily be removed from the framework 204 before disassembly of the framework 204 begins. For instance, the second and fourth first framework pieces $\mathbf{212}_2$, $\mathbf{212}_4$, the first second framework piece $\mathbf{216}_1$, and the first and second third framework pieces $\mathbf{220}_1$, $\mathbf{220}_2$ may in some embodiments be removed from the first configuration of the framework 204 before removing one or more pieces of the PHD 300.

One or more steps of the reassembly of the framework 204 into the second configuration may occur in an order different than specifically disclosed herein. For instance, the fourth first framework piece $\mathbf{212}_4$ may in some situations be attached to the unit 250 before the second second framework piece $\mathbf{212}_2$ is attached to the unit 250. The various uses of "first," "second," "third," etc. herein (e.g., "first first framework piece," "first second framework piece," "second third framework piece," etc.) have been used merely to facilitate the reader's understanding of the various teachings herein and are not meant to limit the disclosure.

In some arrangements, the apparatus 200 may be used in conjunction with other equipment (e.g., stump grinders, scissor lifts, log splitters, etc.) in which both a container and a stand for facilitating connection of such equipment to tractors or the like is desired.

The embodiments described hereinabove are further intended to explain best modes known of practicing the invention and to enable others skilled in the art to utilize the invention in such, or other embodiments and with various modifications required by the particular application(s) or use(s) of the invention. It is intended that the appended claims be construed to include alternative embodiments to the extent permitted by the prior art.

What is claimed is:

1. A method for use with a post hole digger, comprising:

receiving a package that includes a framework made up of a plurality of framework pieces connected together in a first configuration;

removing a plurality of pieces of a post hole digger from an internal space inside of the plurality of framework pieces in the first configuration of the framework;

disassembling the plurality of framework pieces in the first configuration of the framework;

assembling the plurality of framework pieces into a second configuration different than the first configuration; and attaching the plurality of pieces of the post hole digger to the plurality of framework pieces in the second configuration of the framework, wherein the plurality of framework pieces includes a plurality of primary framework pieces, wherein each of the primary framework pieces includes a longitudinal axis, wherein the longitudinal axes of first and second of the primary framework pieces are parallel in the first configuration of the framework, and wherein the longitudinal axes of the first and second primary framework pieces are non-parallel in the second configuration of the framework.

2. The method of claim 1, wherein the longitudinal axes of the first and second primary framework pieces are perpendicular in the second configuration of the framework.

3. The method of claim 2, wherein the plurality of framework pieces includes a plurality of secondary framework pieces, wherein each of the secondary framework pieces includes a longitudinal axis, wherein the longitudinal axes of first and second of the secondary framework pieces are parallel in the first configuration of the framework, and wherein the longitudinal axes of the first and second secondary framework pieces are perpendicular to the longitudinal axes of the first and second primary framework pieces in the first configuration of the framework.

4. The method of claim 3, wherein the longitudinal axis of the first secondary framework piece is non-perpendicular and non-parallel to the longitudinal axis of the first primary framework piece in the second configuration of the framework.

5. The method of claim 1, wherein the longitudinal axes of third and fourth of the primary framework pieces are parallel in the first configuration of the framework, wherein the longitudinal axis of the third primary framework piece is parallel to the longitudinal axis of the first primary framework piece and non-parallel to the longitudinal axis of the second primary framework piece in the second configuration of the framework, and wherein the longitudinal axis of the fourth primary framework piece is non-parallel to the longitudinal axis of the first primary framework piece and parallel to the longitudinal axis of the second primary framework piece in the second configuration of the framework.

6. A kit, comprising:

a framework made up of a plurality of framework pieces connected together in a first configuration, the first configuration of the framework including an internal space inside the plurality of framework pieces;

a plurality of pieces of a post hole digger disposed within the internal space; and instructions comprising first information that directs a user how to disassemble the plurality of framework pieces in the first configuration of the framework and then assemble the plurality of framework pieces into a second configuration different than the first configuration, wherein the instructions further include second information that directs a user how to attach one or more of the plurality of pieces of the post hole digger to the plurality of framework pieces in the second configuration of the framework, wherein the plurality of framework pieces includes a plurality of primary framework pieces, wherein each of the primary framework pieces includes a longitudinal axis, wherein the longitudinal axes of first and second of the primary framework pieces are parallel in the first configuration of the framework, and wherein the first information directs the user to reassemble the plurality of framework pieces such that the longitudinal axes of the first and second primary framework pieces are non-parallel in the second configuration of the framework.

7. The kit of claim 6, wherein the longitudinal axes of the first and second primary framework pieces are perpendicular in the second configuration of the framework.

8. The kit of claim 7, wherein the plurality of framework pieces includes a plurality of secondary framework pieces, wherein each of the secondary framework pieces includes a longitudinal axis, wherein the longitudinal axes of first and second of the secondary framework pieces are parallel in the first configuration of the framework, and wherein the longitudinal axes of the first and second secondary framework pieces are perpendicular to the longitudinal axes of the first and second primary framework pieces in the first configuration of the framework.

9. The kit of claim 8, wherein the first information directs the user to reassemble the plurality of framework pieces such that the longitudinal axis of the first secondary framework piece is non-perpendicular and non-parallel to the longitudinal axis of the first primary framework piece in the second configuration of the framework.

10. The kit of claim 9, wherein the first information directs the user to reassemble the plurality of framework pieces such that the longitudinal axis of the first secondary framework piece is non-perpendicular and non-parallel to the longitudinal axis of the second primary framework piece in the second configuration of the framework.

11. The kit of claim 9, wherein the first information directs the user to reassemble the plurality of framework pieces such that the longitudinal axes of the first and second secondary framework pieces are parallel in the second configuration of the framework.

12. The kit of claim 8, wherein the first information directs the user to reassemble the plurality of framework pieces such that the longitudinal axes of third and fourth of the secondary framework pieces are parallel to the longitudinal axis of the second primary framework piece in the second configuration of the framework.

13. The kit of claim 12, wherein the longitudinal axes of the third and fourth secondary framework pieces are perpendicular to the longitudinal axes of the first and second primary framework pieces in the first configuration of the framework.

14. The kit of claim 12, wherein the first information directs the user to reassemble the plurality of framework pieces such that the longitudinal axes of the third and fourth secondary framework pieces are non-perpendicular and non-parallel to the longitudinal axis of the first and second secondary framework pieces in the second configuration of the framework.

15. The kit of claim 6, wherein the longitudinal axes of third and fourth of the primary framework pieces are parallel in the first configuration of the framework, wherein the first information directs the user to reassemble the plurality of framework pieces such that the longitudinal axis of the third primary framework piece is parallel to the longitudinal axis of the first primary framework piece and non-parallel to the longitudinal axis of the second primary framework piece in the second configuration of the framework, and wherein the first information directs the user to reassemble the plurality of framework pieces such that the longitudinal axis of the fourth primary framework piece is non-parallel to the longitudinal axis of the first primary framework piece and parallel to the longitudinal axis of the second primary framework piece in the second configuration of the framework.

16. The kit of claim 15, wherein the first information directs the user to attach first and second elongated members between the fourth primary framework piece and the first and third primary framework pieces.

* * * * *